United States Patent [19]

Walters

[11] 4,096,482

[45] Jun. 20, 1978

[54] WIDE BAND MONOPULSE ANTENNAS WITH CONTROL CIRCUITRY

[75] Inventor: Glenn A. Walters, San Diego, Calif.

[73] Assignee: Control Data Corporation, Minneapolis, Minn.

[21] Appl. No.: 789,399

[22] Filed: Apr. 21, 1977

[51] Int. Cl.[2] ..... H01Q 13/00

[52] U.S. Cl. ..... 343/778; 343/776; 343/854

[58] Field of Search ..... 343/786, 777, 778, 789, 343/853, 776, 16 R, 16 M, 854

[56] References Cited

U.S. PATENT DOCUMENTS

| | | | |
|---|---|---|---|
| 2,751,586 | 6/1956 | Riblet | 343/786 |
| 3,392,395 | 7/1968 | Hannan | 343/777 |
| 3,482,251 | 12/1969 | Bowes, Jr. | 343/786 |

OTHER PUBLICATIONS

Algeo "A Tri-Mode Four Channel Monopulse Bridge" Microwave Journal Nov. 1966.

*Primary Examiner*—Alfred E. Smith
*Assistant Examiner*—David K. Moor
*Attorney, Agent, or Firm*—Robert M. Angus

[57] ABSTRACT

A wide band monopulse antenna includes a plurality of contiguous square quad-ridged waveguides arranged in a geometric array. Proper orientation of the array permits connection to circuitry to permit use of the individual waveguides for development of azimuth, elevation and sum pattern signals. Further, orientation of concentric arrays permits extension of the frequency band.

5 Claims, 17 Drawing Figures

WIDE BAND MONOPULSE ANTENNAS WITH CONTROL CIRCUITRY

This invention relates to wide band monopulse antenna systems, and particularly to ridged waveguide antennas capable of wide band multi-mode operation.

Single and double ridged waveguides have been standardized for operation over 2.1:1 and 3.6:1 band widths. Power capacity and transmission efficiency of ridged waveguides is not as great as for standard rectangular waveguides, but is better than that associated with coaxial or spiral circuits. Square, quad-ridged waveguides pass both the $TE_{01}$ and $TE_{10}$ orthogonal modes, and when properly driven, can develop any desired polarization. The radiating pattern of the waveguides can be controlled by flaring or by utilizing such waveguides as the primary radiators to illuminate a lens or reflective surface. In the latter case, all apertures lie in a plane such that the phase centers are nearly constant over the band of interest.

One problem associated with wide band antennas resides in the development of wide band hybrid circuits to control polarization and to form monopulse patterns. To overcome these problems, several techniques are employed, including the use of mixers internal to the waveguide assembly, the injection of local oscillator signals, the conversion of the carrier frequency to a common IF frequency, and/or the inclusion of hybrid circuits operated within the relatively narrow IF frequency band.

Desired operational flexibility of a multi-mode antenna (i.e., one capable of operation in both the transmit as well as the receive mode) includes polarization control, monopulse pattern capabilities and pattern optimization in terms of gain, beamwidths, sidelobes, etc. While a particular system can be designed to fulfill certain of these flexibilities, the simultaneous solution of all these problems requires new considerations.

It is an object of the present invention to provide a ridged waveguide antenna system capable of operating over a relatively wide frequency band.

It is another object of the present invention to provide a multi-mode wide band monopulse antenna system capable of developing desired polarization characteristics.

The present invention relates to a ridged waveguide terminated at one end in a transition to waveguide or coaxial transmission lines and open at the opposite end so as to radiate. If linier polarized energy is required, rectangular single or double ridged waveguides may be adequate, whereas if other polarizations are required, a quad-ridged, square waveguide is desirable. The waveguides are arrayed to provide increased directivity, provide monopulse pattern capabilities, etc. Directivity of the waveguides or array of waveguides may be increased by flaring the aperture or by utilizing the array as the primary feed to a lens or reflector. Where extended bandwidths are required, a coaxial array of waveguides may be utilized wherein an array of waveguides operating at the higher band of frequencies is mounted in the center of a second array of waveguides operating in a lower band of frequencies. This arrangement can be extended by increasing the number of waveguide arrays coaxially arranged.

The dimensions of the quad-ridged waveguide are choosen so that both the $TE_{01}$ and $TE_{10}$ modes are transmitted over the frequency range of interest. By varying the phase and amplitude of signals in these two orthogonal modes any desire polarization may be radiated. By arraying four such waveguides and connecting them through proper hybrid circuitry, the sum and difference patterns required for monopulse operations are formed. It is, therefore, one feature of the present invention to provide an antenna system and associated circuitry for development of sum and difference patterns for monopulse operations.

When the waveguides are used for receiving purposes, the terminations at the transmission line or output end of each antenna waveguide may contain a diode mixer. Injecting a local oscillator signal into the waveguide so that both received and local oscillator signals are mixed within the diodes, intermediate frequencies are produced, which, when fed through a coaxial connection containing a suitable filter, selects the IF frequency of interest. This array minimizes losses associated with transmission lines at microwave frequencies and permits external circuits to operate at common, relatively narrow band, intermediate frequencies. Through a proper arrangement of diodes and LO injection mechanism within the ridged waveguide structure, single ended or balanced type mixer circuits may be used for coupling to either or both of the orthogonal transmission modes.

The above and other features of this invention will be more fully understood from the following detailed description and the accompanying drawings, which:

Figure 1:
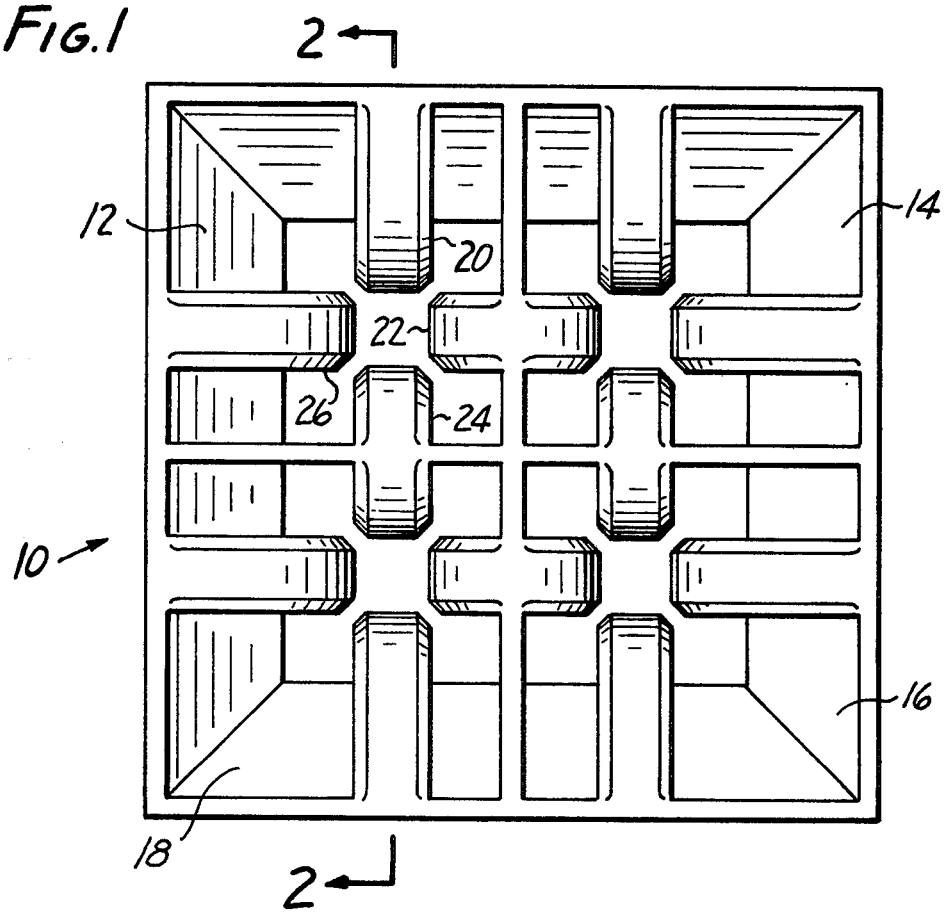
FIG. 1 is an end view of a four horn quad-ridge waveguide array in accordance with the presently preferred embodiment of the present invention.
Figure 2:
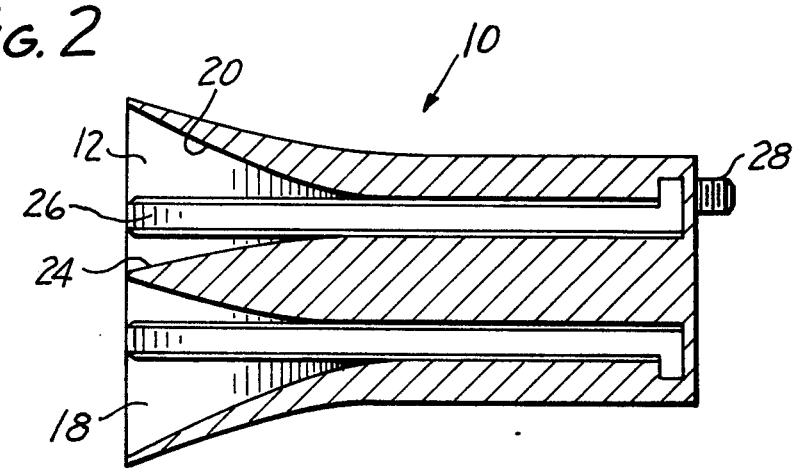
FIG. 2 is a section view taken of at line 2—2 of FIG. 1.

FIGS. 1 and 2 illustrate a four horn array 10 of quad-ridged waveguides in accordance with the presently preferred embodiment of the present invention. Array 10 includes quad-ridged waveguides 12, 14, 16 and 18, each consisting of a quad-ridge waveguide containing ridges 20, 22, 24 and 26 centered on each internal waveguide surface. Each ridge 20, 22, 24 and 26 is approximately $\frac{1}{3}$ the width and height of the guide and is tapered at the edges. Each waveguide 12, 14, 16 and 18 is approximately $0.4\lambda$ at the lowest frequency of operation. The length of each waveguide is on the order of 1 to $2\lambda$ at the lowest operating frequency. The flare angle of each waveguide is choosen to provide proper radiating patterns. If the waveguides are used without lens or reflecting surfaces, the radiating aperture is made as large as possible, consistent with installation constraints for maximum gain or directivity. If the waveguides are used as a primary radiator, the flaring of the waveguides will be dictated by the F/D ratio of the secondary reflector. In any case, the waveguide dimensions relate to the operational freuquency and mode of operation, which, for the present invention would be dictated by the basic $TE_{01}$ and $TE_{10}$ modes.

As illustrated, particularly in FIG. 2, the tapering of ridges 20 and 26 raises the waveguide impedance, and raises the cutoff frequency of the waveguide. A suitable coaxial connection 28 connects to an isolated section of the waveguide ridge to provide a matched coaxial connection to the ridged waveguide transition. Separate connections may be provided to couple to each of the two linear modes of transmission.

As is well known in the art, the waveguide may include a suitable dielectric media within the space of the waveguide to relieve the cut-off frequency problems. Also, a dielectric matching section (not shown) may be utilized to match the horn impedance to that of free space.

Figure 3:
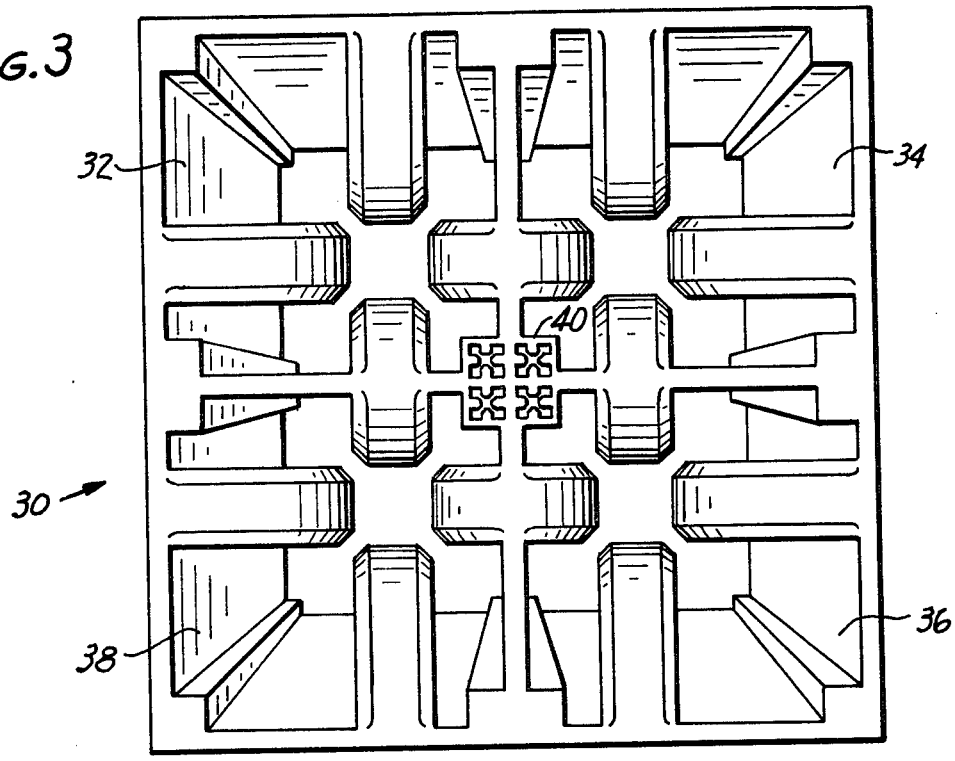
FIG. 3 is an end view of a concentric quad-ridged waveguide array in accordance with a modification of the present invention.

FIG. 3 illustrates a concentric array of ridged waveguides for extending the operational bandwidth of the radiating system. As shown in FIG. 3, the array includes a plurality of ridged waveguides, 32, 34, 36 and 38 similar to guides 12, 14, 16 and 18 of array 10. illustrated in FIGS. 1 and 2. A second array 40 of four quad-ridged waveguides is disposed concentric within array 30. Each waveguide is operated over a restricted bandwidth within the range of frequencies of interest. In this respect, the bandwidth of each waveguide may be generally between about 0.5 and 1.6 octaves. However, the array of waveguides 32, 34, 36 and 38 operates in a lower range of frequencies while array 40 operates in a higher, contiguous range of frequencies.

Figure 4:
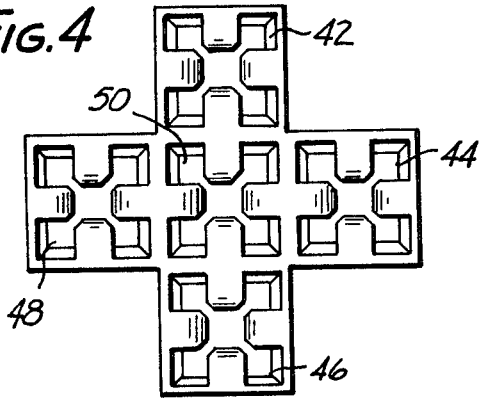
FIG. 4 is an end view of a five horn quad-ridged waveguide array in accordance with yet another modification of the present invention.

FIG. 4 illustrates an array of five square quad-ridged waveguides having waveguides 42, 44, 46 and 48 surrounding a fifth waveguide 50 centrally disposed between the other four. The outer waveguides 42, 44, 46 and 48 may be utilized to form the different monopulse patterns.

Figure 5:
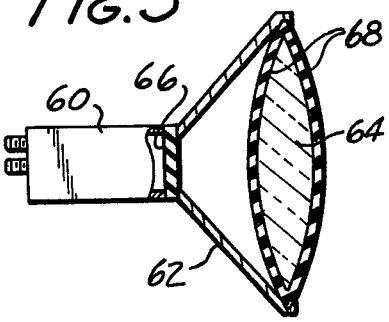
FIG. 5 is a section view illustrating an antenna array in accordance with the present invention used in combination with a suitable lens or reflector.

FIG. 5 illustrates the combination of a quad-ridged array of waveguides in combination with a suitable lens to achieve higher gain and directivity. Array 60 is connected to a flare horn 62 which in turn terminates in lens 64. Dielectric sections 66 and 68 may be provided to match impedance between the horns/lens/ space interfaces. Utilization of a lens provides a greater aperture for the array with a corresponding increased directivity and improved pattern characteristic. Ordinarily, and as is well known in the art, the dielectric may be of any suitable low loss dielectric preferably having a dielectric constant between about 2.5 and 5.

Figure 6:
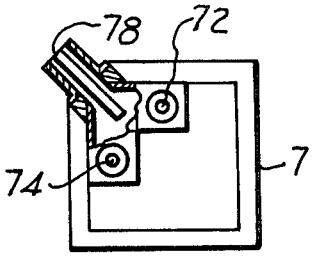
FIG. 6 is a rear view of a waveguide antenna illustrating the principles of IF conversion.
Figure 7:
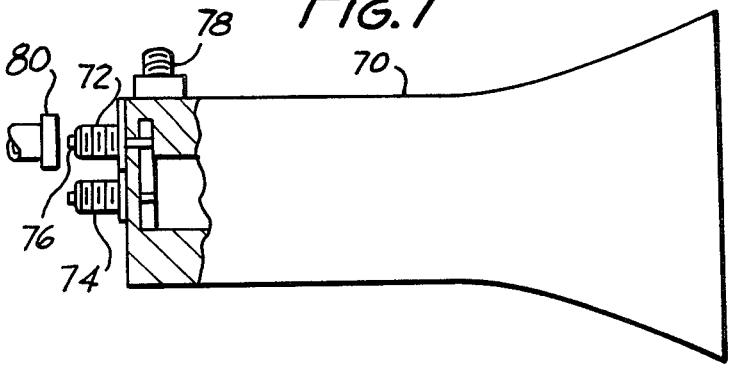
FIG. 7 is a side view, partly in cutaway cross-section, of the waveguide antenna illustrated in FIG. 6.

FIGS. 6 and 7 are taken together, illustrate the inclusion of suitable IF conversions for use with a quad-ridged waveguide antenna used for receiving purposes. Waveguide 70 includes coaxial terminations 72 and 74 each of which may include a suitable mixer diode 76. Terminal 78 injects a local oscillator signal into waveguide 70 for mixing at both diode terminals. Coaxial connector 80 ordinarily includes a suitable IF band pass filter. Received signals mix with the local oscillator signal and are converted to an intermediate frequency through the combined circuitry.

Figure 8A:
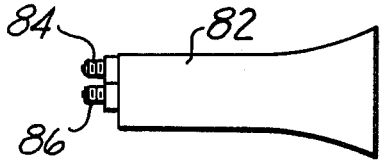
FIG. 8A is a section view of a typical quad-ridged waveguide for connection with the circuits illustrated in FIGS. 8B, 8C and 8D to illustrate various operational modes of a typical quad-ridged waveguide antenna.
Figure 8B:
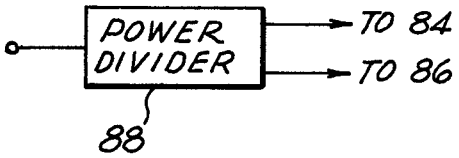
Figure 8C:
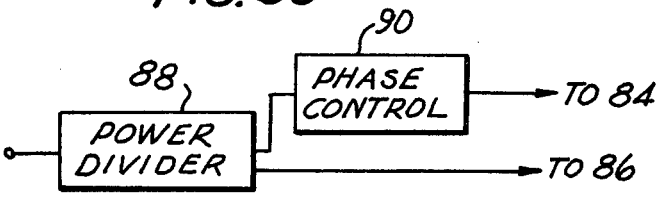
Figure 8D:
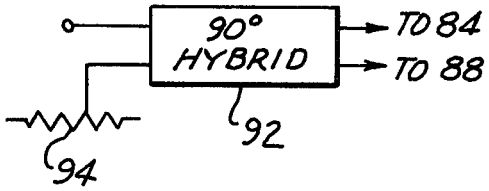

With reference to FIGS. 8A through 8D, it can be illustrated that quad-ridged guides may be connected to provide of an electromagnetic wave of any desired polarization. As illustrated in FIG. 8A quad-ridged waveguide 82 includes coaxial terminal 84 and 86. FIG. 8C illustrates a rotatory linear polarization control for waveguide 84 wherein a signal inputted to power divider 88 provides in phase signals to connectors 84 and 86. By varying the coupling ratio of the power divider, the polarization vector of the linearly polarized wave can be rotated from the vertical, through 45°, to horizontal by directing the power 100% to connector 84, through 50% to each of connectors 84 and 86, and 100% to connector 86, respectively. As illustrated in FIG. 8C, the addition of a phase control 90 can cause the desired polarization to be radiated through any desired configuration through appropriate choice of relative power and phase of orthogonal modes. Circular polarization may be achieved utilizing the hybrid circuit illustrated in FIG. 8D. An equal power split and 90° phase differential is accomplished by inputting through a 3dB, 90° hybrid circuit 92 to connectors 84 and 86. A fourth terminal terminates in load 94. Rotational sence of the circularly polarized wave can be achieved by reversing either of the input or output connections to the hybrid circuit 92.

Figure 9A:
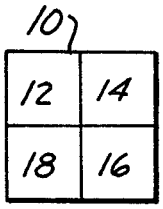
FIGS. 9A and 9B, 9C and 9D, 9E and 9F are illustrations useful in explaining the operation of the waveguide antenna arrays illustrated in FIGS. 1 and 4 of missile guidance purposes.
Figure 9B:
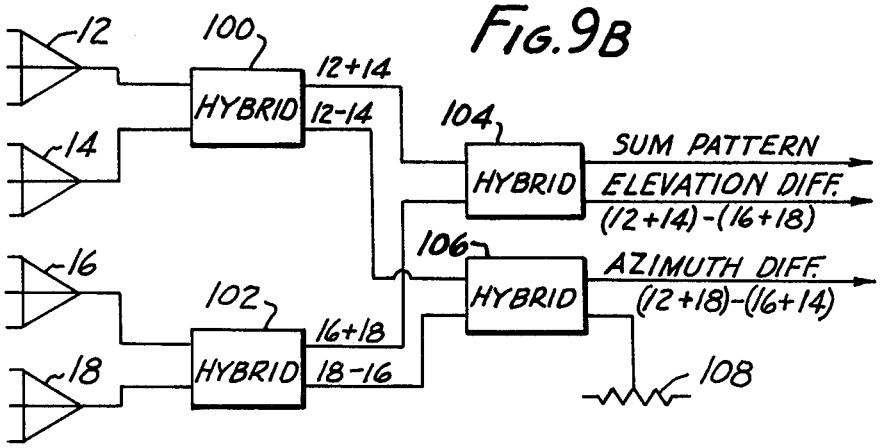

FIGS. 9A through 9F illustrate typical monopulse circuits of a quad-ridge array of waveguides. The arrangement illustrated in FIGS. 9A through 9F are particularly useful as small aperture wide band antennas for missile guidance purposes. In this respect, these arrays provide azimuth and elevation difference patterns as well as sum patterns. With array 10 (as illustrated in FIG. 1) orientated as illustrated in FIG. 9A, the outputs received from waveguides 12 and 14 are inputted to hybrid circuit 100 whereas the outputs from guides 16 and 18 are input to hybrid circuit 102. Each of hybrid circuits 100 and 102 provide two outputs, one consisting of the sum of the inputs and the other consisting of the difference between the inputs. The sum outputs from hybrid circuits 100 and 102 are inputted to hybrid circuit 104 whereas the difference outputs from circuits 100 and 102 are inputted to hybrid circuit 106. The sum of output from hybride circuit 104 provides the sum pattern output of guides 12, 14, 16 and 18. The difference output of hybrid circuit 104 provides an elevation difference signal consisting of the signals received from waveguides (12 + 14) minus (16 + 18). The sum output from bridge circuit 106 is terminated in load 108. The difference output from hybrid circuit 106 provides the azimuth difference pattern consisting of the outputs from waveguides (12 + 18) minus (14 + 16).

Figure 9D:
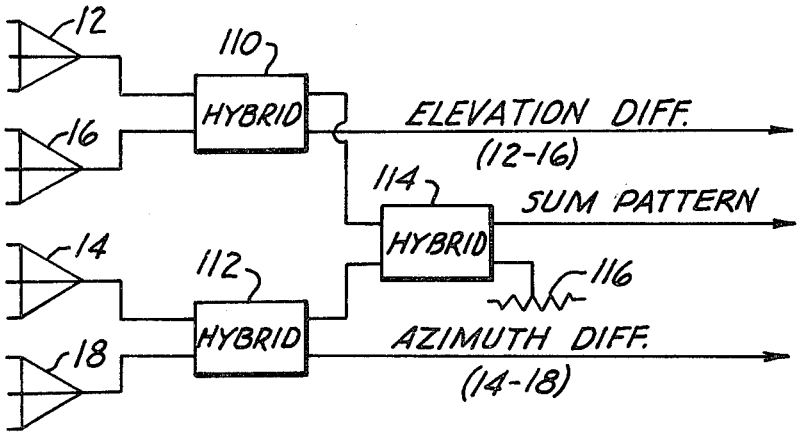
Figure 9C:
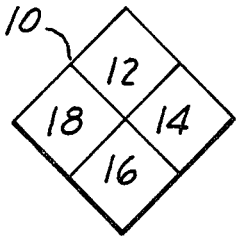

When array 10 is oriented as illustrated in FIG. 9C, the circuit of FIG. 9D may be utilized to obtain elevation, azimuth and sum patterns. In this respect, the outputs of waveguides 12 and 14 are inputted to hybrid circuit 110 whereas the outputs from the waveguides 16 and 18 are inputted to hybrid circuit 112. The sum outputs from circuits 110 and 112 are inputted to hybrid circuit 114. The difference output from circuit 110 provides the elevation difference pattern consisting of the outputs from waveguides 12 minus 16. The difference output from circuit 112 provides the azimuth difference pattern consisting of the difference between the outputs of waveguides 14 and 18. The sum output from hybrid circuit 114 provides the sum pattern of all four waveguides whereas the difference output from circuit 114 is terminated in load 116.

Figure 9E:
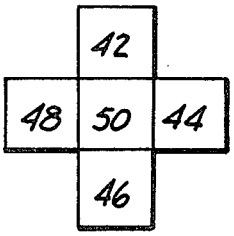
Figure 9F:
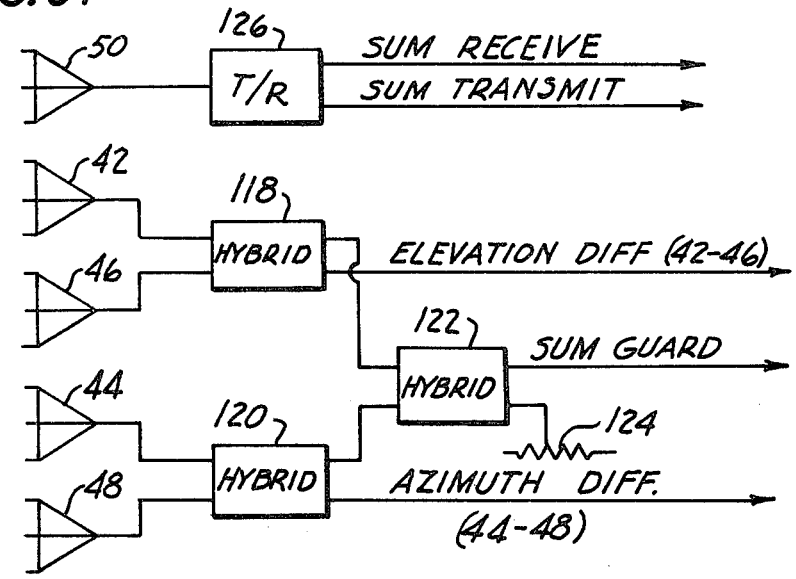

Utilizing the five waveguide array illustrated in FIG. 4, as shown in FIG. 9E, circuits such as illustrated in FIG. 9F may be utilized. The outputs from waveguides 42 and 46 are inputted to hybrid circuit 118 to provide an elevation difference pattern consisting of difference between the outputs of waveguides 42 and 46. The outputs from waveguides 44 and 48 are inputted to hybrid circuit 120 to provide an azimuth difference pattern consisting of the difference between the outputs of waveguides 44 and 48. The sum outputs from hybrid circuits 118 and 120 are inputted to hybrid circuit 122 to provide a sum guard channel output consisting of the sum of outputs of waveguides, 42, 44, 46 and 48. The difference output from hybrid circuit 122 is terminated in load 124. Waveguide 50 provides an independent sum pattern and is connected to circuit 126. Where the array is utilized for both transmit and receive capabilities, circuit 126 may be a conventional circulator to transmit and receive sum patterns. For higher power operation, circuit 126 will be conventional transmitting and receiving circuitry, well known in the art.

The present invention thus provides an array of quad-ridged waveguides capable of monopulse operations over band widths wider than heretofore achieved in the art. The apparatus is simple in operation and rugged in use.

This invention is not to be limited by the embodiments shown in the drawings and described in the description, which are given by way of example and not of limitation, but only in accordance with the scope of the appended claims.

What is claimed is:

1. A monopulse antenna system comprising, in combination: at least four quad-ridged horns, each having a square horn aperture and a waveguide section, each horn having four side walls extending between said waveguide section and said horn aperture, each side wall having a flared ridge having a maximum height from the respective side wall adjacent said waveguide section and flaring to a minimum height at said horn aperture, each horn having a bandwidth in excess of one octave, said horns being arranged in a geometric array and being so disposed and arranged that the horn aperture of each horn is contiguous to the horn aperture of at least one other horn; dielectric means at the horn aperture of each of said horns for matching the impedance between the respective horn and free space; electronic circuit means for processing signals in each of said horns; and coupling means connected to each of said horns at the respective waveguide sections and to said circuit means for transmitting electrical energy between said horns and said circuit means.

2. An antenna system according to claim 1 wherein said array consists of four horns arranged in a square pattern so that two of said horns are positioned above respective ones of the other two of said horns, said coupling means being capable of transmitting energy from each of said horns to said electronic circuit means, said circuit means including first means for deriving a first signal representative of the algebraic sum of the energy received from all of said horns, second means for deriving a second second signal representative of the algebraic dfference between the sum of the energy received from the two upper horns and the sum of the energy received from the two lower horns, and third means for deriving a third signal representative of the algebraic difference between the sum of the energy received from the two horns on one side of the array and the sum of the energy received from the two horns on the opposite side of the array.

3. An antenna system according to claim 1 wherein said array is so disposed and arranged that one of said horns is positioned substantially above the other horns, a second of said horns is positioned substantially below the other horns, a third of said horns is positioned substantially to one side of the other horns and a fourth of said horns is positioned substantially to the opposite side of the other horns, said coupling means being capable of transmitting energy from each of said four horns to said electronic circuit means, said circuit means including first means for deriving a first signal representative of the algebraic sum of the energy received from all of said four horns, second means for deriving a second signal representative of the algebraic difference between the energy received from said first and second horns, and third means for deriving a third signal representative of the algebraic difference between the energy received from said third and fourth horns.

4. An antenna system according to claim 3 wherein said array includes a fifth horn so disposed and arranged that the horn aperture of said fifth horn is contiguous the horn apertures of each of said other four horns, said circuit means further including transmitter-receiver means, and said coupling means associated with said fifth horn being capable of transmitting energy from said transmitter-receiver means to said fifth horn when said transmitter-receiver means is operated in a transmission mode an being capable of transmitting energy from said fifth horn to said transmitter-receiver means when said transmitter-receiver means is operated in a receive mode.

5. An antenna system according to claim 1 wherein said array includes a first group of at least four horns and a second group of at least four horns, said second group of horns being positioned concentrically within said first group of horns, and each horn of said first group being of substantially the same size and each horn of said second group being of substantially the same size and smaller than each horn of said first group, said electronic circuit means operating said second group of horns at a mean frequency higher than the mean frequency of operation of said first group of horns.

* * * * *